United States Patent [19]

Smith

[11] Patent Number: 4,711,190

[45] Date of Patent: Dec. 8, 1987

[54] DECORATIVELY STITCHED TRIM PART AND METHOD

[75] Inventor: Jack E. Smith, Dayton, Ohio

[73] Assignee: General Motors Corporation, Detroit, Mich.

[21] Appl. No.: 899,051

[22] Filed: Aug. 22, 1986

Related U.S. Application Data

[60] Continuation-in-part of Ser. No. 648,300, Sep. 6, 1984, abandoned, which is a division of Ser. No. 552,408, Nov. 16, 1983, Pat. No. 4,488,498.

[51] Int. Cl.[4] ..... D05C 15/00

[52] U.S. Cl. ..... 112/266.2

[58] Field of Search ..... 112/410, 266.1, 266.2, 112/439; 156/140

[56] References Cited

U.S. PATENT DOCUMENTS

| | | | |
|---|---|---|---|
| 1,304,811 | 5/1919 | Schick | 112/410 |
| 1,477,430 | 12/1923 | Creigton | 112/80 |
| 1,937,257 | 11/1983 | Van Dyke | 112/80 |
| 2,565,135 | 8/1951 | Knittner | 112/80 |
| 2,753,820 | 7/1956 | Lustig | 112/80 |
| 2,866,206 | 12/1958 | Gebert | 112/410 |
| 3,246,176 | 3/1966 | Morrison | 112/266.1 |
| 3,430,590 | 3/1969 | Looper | 112/80 |
| 3,520,435 | 3/1971 | Morrion | 112/266 |
| 4,006,694 | 2/1977 | Thaheld | 112/80 |
| 4,479,445 | 10/1984 | Walker | 112/80 |

FOREIGN PATENT DOCUMENTS

| | | | |
|---|---|---|---|
| 2402811 | 7/1975 | Fed. Rep. of Germany | 112/80 |
| 132211 | 1/1919 | United Kingdom | 112/410 |

OTHER PUBLICATIONS

Embroidery Booklet, "Fun with Needle Punch", pp. 4–7.

*Primary Examiner*—Ronald Feldbaum

*Attorney, Agent, or Firm*—Patrick M. Griffin

[57] ABSTRACT

A trim part of the type having a visible outer surface and a resilient foam substrate is provided with real thread decorative stitching. Visible loops of the thread are tensioned against the outer surface by embedded loops held in the resilient substrate. A method is disclosed for applying the decorative stitching with two different types of thread, which is done by partially penetrating the foam substrate to a controlled depth in a repeating pattern.

1 Claim, 10 Drawing Figures

DECORATIVELY STITCHED TRIM PART AND METHOD

This is a continuation-in-part of Ser. No. 648,300, filed Sept. 6, 1984 abandoned, which is a division of Ser. No. 552,408, filed Nov. 16, 1983, now U.S. Pat. No. 4,488,498.

This invention relates to decoratively stitched trim parts and method for making such trim parts, and specifically to a trim part having a series of real thread decorative stitches on the outer surface thereof and a method for providing that stitching.

BACKGROUND OF THE INVENTION

Vehicle trim parts, such as instrument panel pads, generally include a top layer of vinyl and a bottom layer or substrate of resilient foam, such as urethane foam. The vinyl top layer often has simulated decorative stitching that is molded integrally therewith. This kind of simulated stitching can have only a limited visual similarity to functional stitching, since it necessarily has the same color and appearance as the vinyl top layer with which it is integrally molded. A decorative stitching provided by real thread could have been essentially visually identical to functional stitching. A suitable real thread decorative stitching on such a trim part would require visible loops that lay flat on and tensioned against the top layer of the trim part, both for desirable appearance and so as to not be pulled out of the trim part during ordinary use of the vehicle. Also, the thread from which a suitable decorative stitching was formed would have to be relatively thin, tough and incompressible, both so as to properly visually simulate functional stitching, and so as to stand up to wear on the surface of the trim part.

Conventional machine stitching, where access necessary both above and below the part top to be stitched, is unsuitable for providing decorative stitching to a trim part of the type described above, either to the completed trim part, or to its top layer alone. Generally, such a trim part is manufactured by first molding the vinyl top layer, and then injection molding the foam substrate to the back of the vinyl top layer. The completed trim part so formed is generally far too thick to be stitched in a typical sewing machine, and is also irregular in thickness and shape. Such trim parts may have inserts in the foam which also make it impossible to fully pierce the trim part with a needle, precluding conventional machine stitching. While it is theoretically possible to stitch just the vinyl top layer on a sewing machine before the foam substrate is molded to it, this is not a practical option. The vinyl material is not elastic, and the holes formed in it by the stitching needle would thus not close up around the thread stitches sufficiently to prevent the injection molded foam from leaking through the holes. It would also be difficult to align such a pre-stitched vinyl layer in the mold, that is, so that the line of stitches was in the proper place, and unacceptable trim parts would have to be scrapped after the most labor intensive step, the stitching, had been completed. And, of course, not even this impractical option is available in cases where the trim part does not have a separate vinyl top layer, but only a visible upper surface provided by an integrally formed skin of the foam substrate. Therefore, as a practical matter, real thread decorative stitching has to be applied to the completed trim part, and stitching access is available from only one side of the trim part, that is, from above.

Known stitching methods that require only one side access do not provide an acceptable alternative to conventional machine stitching, whether applied to completed trim parts or separately to just the top layer. Such methods are inapplicable because of the techniques, the apparatuses and the materials used. One such known method is generally referred to as embroidery. Materials to be embroidered must have generally uniform thickness, be relatively thin, and must be stretched tightly across a frame, which is clearly unsuitable to a trim part. Furthermore, typical embroidery techniques and needles would be unworkable if applied to a trim part. Embroidery needles have a graspable handle and a narrow, hollow shaft with a central thread passage and a slanted tip, having a trailing side and a leading side. The trailing side of the needle tip includes a sharp piercing point and an eye therethrough just above the point. Thread is fed through the shaft central passage with a thread free end passing out through the eye. The needle is punched through the material from one side, until the handle engages the material. As the needle is pulled back through the material, the eye catches the thread and pulls it back to create a loop on the other side of the material having a length that is half the distance that the needle was originally punched through the material. When the needle is pulled back through the material, the tip must be dragged across the material for a short distance without raising it above the surface, and then punched through the material again to repeat the process. This process leaves a row of short, flat stitches on one side of the material, which will be unseen since that side will be the underside of the completed product, and visible loop stitches on the other side of the material. The visible loop stitches are pinched and held by the relatively thin material where they pass through it, held with sufficient force to keep the loops from being pulled up and out of the material. The material could be reversed, to make the flat stitches visible instead, but the method still would not be practical if applied to just the top vinyl layer of a trim part. There is nothing to keep the flat stitches tensioned against the material, nor need there be, since they are on what will be the underside of the material, and nothing would normally tend to pull them away. Furthermore, since the vinyl top layer of a trim part is not elastic, the flat stitches would not be held even with the force of conventional embroidery stitching, and would not stay in place properly while the top layer was handled during the substrate foaming step. And, just as with machine stitching, the holes left in the top layer would jeopardize the later foaming of the substrate. Nor would the embroidery method be any more applicable to the completed trim part. If an embroidery needle were to be punched only partially through a relatively thick trim part, the thread would simply be pulled back out again by the needle eye when the needle was withdrawn.

Other known methods of one side access stitching are also unworkable with trim parts of the type described. It is also known to provide embroidery type stitching by machine in a dense pattern to create what is known as tufted or pile fabric. Such methods are no more applicable to a trim part of the type described than hand stitching, of course. U.S. Pat. No. 3,240,176 to Morrison teaches a method of providing what is referred to as "simulated embroidery", in which the visible loop stitches and invisible flat stitches of conventional embroidery are, in effect, reversed. Morrison eliminates the fabric stretching frame of conventional embroidery by backing an elastic material with a collapsible foam spacer. A thick and compressible yarn is pushed in loops by a punch through undersized holes in the elastic material, which collapses the foam spacer with little resistance and without crushing the yarn loops, much as a conventional embroidery needle would push through fabric stretched on a frame. The undersized holes in the elastic material pinch and compress the neck of the yarn loops, leaving substantially flat visible loops on the top surface. The foam spacer may subsequently be discarded. It is the elasticity of the top layer and its action of pinching the compressible yarn that provides the sole retention force, and, as a consequence, the visible flat loops lie untensioned on the upper surface. This is unsuitable for vehicle trim parts, since the visible loops must lie in tension. Furthermore, the typical top layer of such a trim part is not sufficiently elastic to provide that kind of pinching retention. Yarn is also totally unsuitable, because it would stretch and likely break if it were attempted to punch it into the much harder foam of a typical trim part, and it is far too soft, thick and stretchable for the environment involved.

SUMMARY OF THE INVENTION

The subject invention solves the above problems and shortcomings of the prior art by providing a trim part having decorative stitching which is formed from real thread, and therefore has a very close visual appearance to functional stiching, and also provides two embodiments of a method for applying such decorative stitching.

The decorative stitching of the invention is formed of a continuous thread arranged in a series of visible loops, which are properly tensioned against the visible outer surface of the top layer of the trim part. Each visible loop is integral with a pair of adjacent embedded loops, which are embedded sufficiently into the resilient foam substrate of the trim part so as to be frictionally retained thereby, and which therefore maintain the visible loop between them under tension. The decorative stitching can be applied regardless of the thickness of the trim part, without damage to the trim part, and with access necessary only from the outer or visible side of the trim part.

The decorative stitching of the invention is applied by a hollow needle having a central thread receiving passage with an open end slanted to give a piercing leading edge and an open notch on the trailing edge. In a first embodiment of the method, a thin continuous thread of incompressible material extends through the central passage and out the open end a distance slightly longer than the length of the needle. Initially, the piercing leading edge of the needle is inserted into the trim part through the top layer and penetrates into the foam substrate to a depth which is termed an embedment distance. The needle drags the thread with it since a portion of the thread is captured in the open notch of the trailing edge. The embedment distance is defined as that depth that leaves sufficient thread in contact with the pierced foam substrate such that the pierced foam will close up on and frictionally hold the embedded portion of the thread. Then, the fact that the embedded thread is held in the foam substrate will cause additional thread to feed through the needle as the needle is withdrawn from the trim part, thereby leaving a complete loop embedded in the foam. The needle is withdrawn above the visible outer surface of the trim part for what is termed the withdrawn distance, and is also indexed or moved forward along the path to be stitched by the desired length of a visible loop. As the needle is so moved, thread continuously feeds through the hollow needle because the foam holds the embedded loop of the thread as described. The needle is moved up and forward in such a way as to feed enough thread though the hollow needle for a visible loop, and for one half of the next embedded loop.

Then, the needle is again penetrated into the trim part for the same embedment distance and is withdrawn again for the same withdrawn distance to complete the next embedded loop in the series. As each embedded loop is so formed, it pulls the thread behind it tight against the outer surface of the trim part to form a visible loop between the two adjacent embedded loops. The top layer of the trim part is not sufficiently elastic to close on and hold the neck of the embedded loop and thereby maintain the visible loop under tension, but the force with which each adjacent pair of embedded loops is held in the foam does maintain the visible loop between them well tensioned against the visible outer surface. In addition, since thread used in the first embodiment is relatively pliable, though tough, the vilible loops lie substantially flat against the outer surface. This process is repeated as many times as necessary to form the desired number of stitches. The free end of the thread that extends above the outer surface of the trim part at both the initial and the last embedded loop in the series can be cut off.

In a second embodiment of the method, the same needle is moved in the same way to leave the same pattern of thread in the trim part, with embedded loops retained in the same way in the foam. However, the thread used, though still incompressible and of essentially the same size, is relatively stiffer as well as being heat shrinkable, and may also be coated with heat curable adhesive, if desired. After the stitching has been applied, the visible loops of the stiffer thread do not lie as flat against, or in as tight a tension against, the outer surface as in the first embodiment. Therfore, in an additional and final stip, a heat gun is run down the line of stitching to shrink the visible loops flat into tighter tension, also curing any adhesive on the thread to give additional retention to the visible loops.

It is therefore a broad object of the invention to provide real thread decorative stitching to a trim part of the type described so as to give a better visual similarity to functional stitching.

It is another object of the invention to provide such real thread decorative stitching comprising a series of visible loops joined by intermediate loops embedded in and frictionally retained in the resilient substrate so as to maintain the visible loops properly tensioned against the outer surface of the trim part.

It is yet another object of the invention to provide such real thread stitching to a trim part of the type described with a hollow needle having a slanted end providing a leading piercing edge and a trailing notch by repeatedly piercing the visible outer surface of the trim part with the needle piercing edge while capturing a portion of the thread on the notch and penetrating the trim part sufficiently that the captured thread portions will be frictionally retained as loops embedded in the resilient substrate, with the visible loops between the embedded loops thereby maintained in tension against the outer surface of the trim part.

It is still another object of the invention to provide such decorative stitching with a stiffer and heat shrinkable thread, so that the visible loops, while not initially maintained in as tight a tension against the visible outer surface of the trim part, may be heat shrunk into tighter tension as a final step.

BRIEF DESCRIPTION OF THE DRAWINGS

These and other objects and features of the invention will appear from the following written description and drawings in which.

BRIEF DESCRIPTION OF THE PREFERRED EMBODIMENT

Figure 1:
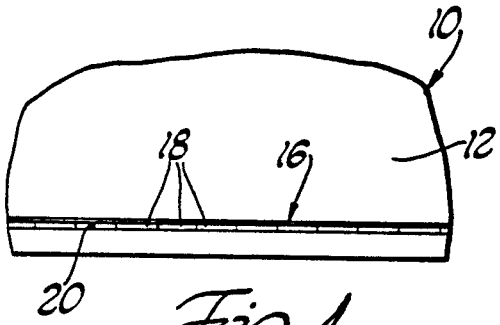
FIG. 1 is a section of a trim part including the decorative stitching of the invention.
Figure 2:
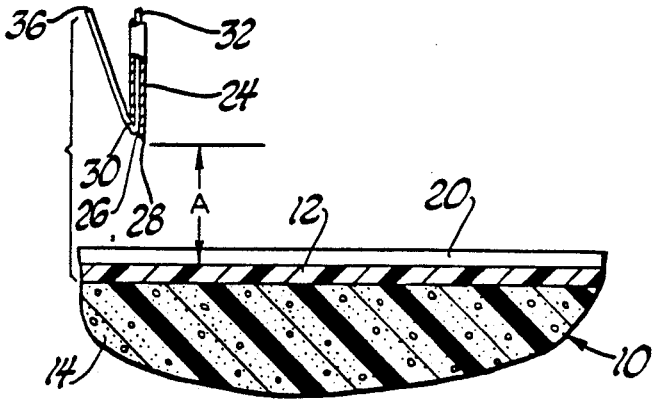
FIGS. 2 through 8 show such a trim part in cross section and the various steps of a first embodiment of a method for applying the stitching.

Referring to FIGS. 1 and 2, a trim part designated generally at 10, which is an instrument panel as disclosed, has a visible outer surface 12 with an underlying and relatively thicker resilient foam substrate 14. As disclosed, the visible outer surface 12 is provided by a top vinyl layer, which is approximately a sixteenth of an inch thick. The vinyl top layer lacks substantial elasticity and, if pierced, will not close up completely when the object that has pierced it is withdrawn, which makes it unsuitable for providing a retention force for any stitching. As such, the top layer's function is primarily to provide the desired appearance and color to the outer surface 12 of the trim part 10. The vinyl top layer does, however, also confine the foam 14 when it is injection molded. The vinyl layer is clamped in a mold in the desired shape of the instrument panel, and the foam substrate 14 is then injection molded to its back surface. The foam substrate 14 disclosed is urethane foam, which is tough and resilient, and which will close up substantially if pierced, unlike the vinyl top layer. Though only a partial cross section is shown, resilient foam substrate 14 would, in practice, be thick and irregular, as is normal in instrument panels, and could also include various rigid inserts, not shown. It should also be kept in mind that the visible outer surface 12 could be provided by an integral skin of the foam substrate 14 itself, rather than by a separate layer. This would make little difference to the practice of the invention, as will appear further below, because such an integral skin would also not be suitable as such for retaining stitching.

Figure 8:
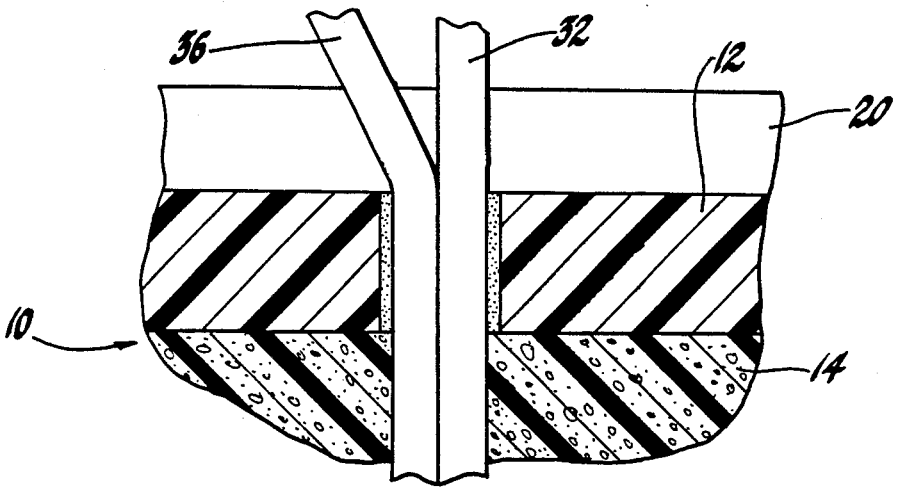

Referring now to FIGS. 1 and 8, decorative stitching applied by a first embodiment of the method of the invention is designated generally at 16, and is comprised of a series of visible loops 18 which are located in a groove 20 and tensioned against the visible outer surface 12. The loops 18 are maintained in that tension by a series of intermediate integral embedded loops 22, which are frictionally held in the foam substrate 14 in a manner described further below. A groove like groove 20 is often provided in the vinyl top layer of trim parts such as trim part 10, but is not absolutely necessary for the practice of the invention. Unlike conventional simulated stitching, which is molded integrally with and of the same material and color as the visible outer surface 12, the decorative stitching 16 is formed of real thread, and theefore has the appearance of functional stitching. However, stitching 16 is applied with access only from above the trim part 10, and without entirely penetrating the trim part 10, as functional stitching would. The method of applying stitching 16 is next described.

Referring now to FIGS. 2 through 8, the method of the invention uses a movable hollow needle 24, the end portion of which is shown, which has a central thread receiving passage and an open, slanted end 26 that provides a leading piercing edge 28 and a trailing edge notch 30. As disclosed, needle 24 has an outside diameter of approximately fifty thousandths of an inch, and an inside diameter of approximately 33 thousandths of an inch. Needle 24 can be moved by any suitable apparatus, such as a robot, along any path desired. One possible apparatus, which guideably moves needle 24 along the line of the groove 20, is the subject of U.S. Pat. No. 4,488,498, assigned to the assignee of the subject invention. Stitching 16 is formed of a continuous thread 32 which is relatively thin, approximately fifteen thousandths of an inch in diameter, and which, in the first embodiment, is also of a material such as cotton, which is relatively pliable, but which is still tough and substantially incompressible. A softer and compressible material would not be suitable to the environment of an instrument panel trim part. Thread 32 is supplied from a suitable source, such as a spool or box, not illustrated, through the central thread receiving passage and out through needle end 26. As shown in FIG. 2, the leading edge 28 of needle end 26 is initially located a predetermined distance A above outer surface 12, which is defined further below, and which may be termed the withdrawn distance. The thread 32 extends upwardly from the needle end 26 back to its source, and is captured and held by the trailing edge notch 30 of the needle end 26.

Figure 3:
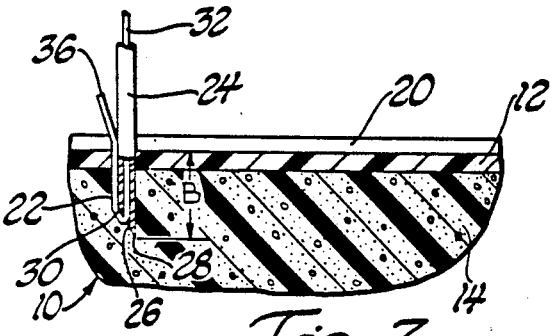

Referring now to FIG. 3, needle 24 is punched perpendicularly downward so that the leading piercing edge 28 pierces the visible outer surface 12 of the top vinyl layer and penetrates partially through the resilient foam substrate 14 to a predetermined distance B, which may be termed the embedment distance. During this penetration by the needle 24, a portion of the thread 32 is captured and held by notch 30 so that it does not move relative to needle 24, and is thereby dragged down into the foam substrate 14, running up along the side of the needle 24. If a compressible or elastic thread were used instead of thread 32, it would not be sufficiently tough to stand up to the needle 24 and the force necessary to pierce the foam 14, which is relatively hard and tough. Furthermore, it could not be assured that such a thread, being stretchable, would be embedded to the same depth that the needle end 26 penetrated, which is important, as will appear. Given the relative sizing of thread 32 and needle 24 described above, it is clear that the needle 24 pierces a hole in both the outer surface 12 and the foam substrate 14 that is, at least initially, larger than the thread 32. The embedment distance B may be defined as that depth that positions enough of the captured portion of the thread 32 into contact with the pierced foam substrate 14 that it will be frictionally held and retained in the foam 14 as the needle 24 is withdrawn. The embedment distance B will obviously vary depending upon how well the surface of the surface of the thread 32 and the foam 14 adhere to one another. However, it should be kept in mind that thread 32 is substantially incompressible, so its own resilience cannot contribute significantly to its retention.

Figure 4:
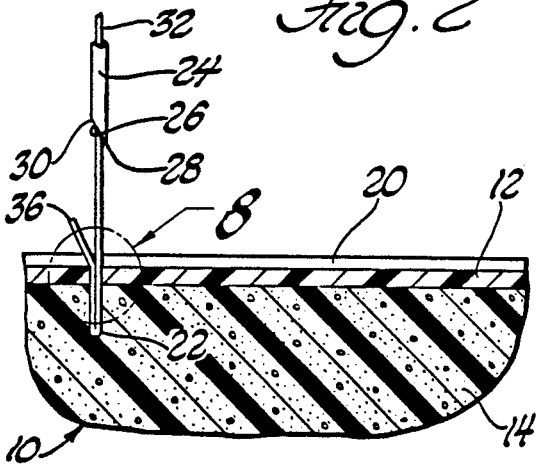

Referring now to FIGS. 3, 4, and 8, needle 24 is next withdrawn from the FIG. 3 position to the FIG. 4 position, its end 26 moving a total distance that is essentially the sum of the embedment and withdrawn distances B and A, which puts it back to a net distance A above the outer surface 12. As needle 24 is so withdrawn, the fact that the embedded portion of the thread 32 is frictionally held in the foam substrate causes additional thread 32 to feed continuously through the hollow needle 24, thereby leaving a complete embedded loop 22 in the foam substrate 14. Thread 32 feeds freely through the central passage of the hollow needle 24, since it is not caught in notch 30 when the needle 24 moves up. As can best be seen by comparing the enlargement of FIG. 8 to FIG. 3, what happens as the needle 24 is withdrawn is that the pierced resilient foam substrate 14 closes up on and frictionally holds both halves of the embedded loop 22, but the pierced outer surface 12, which is not elastic, does not close up completely on the embedded loop 22 where it passes through the outer surface 12. Thus, the retention of the embedded loop 22 comes only from the foam 14 closing up on it. The retention force does not come from any resilience or elasticity of the thread 32, which is minimal in any thread that is suitable to the environment involved.

Figure 5:
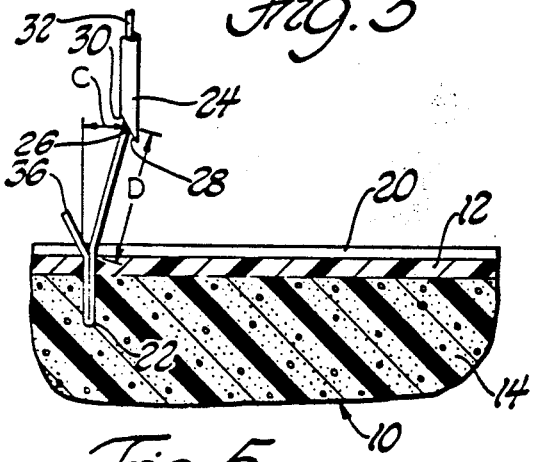
Figure 6:
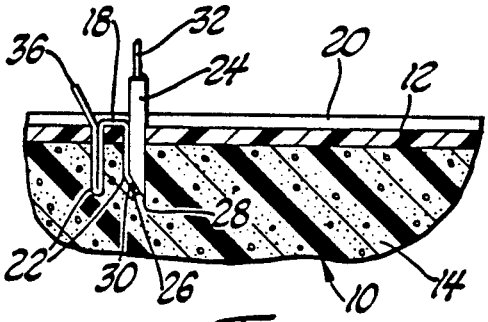
Figure 7:
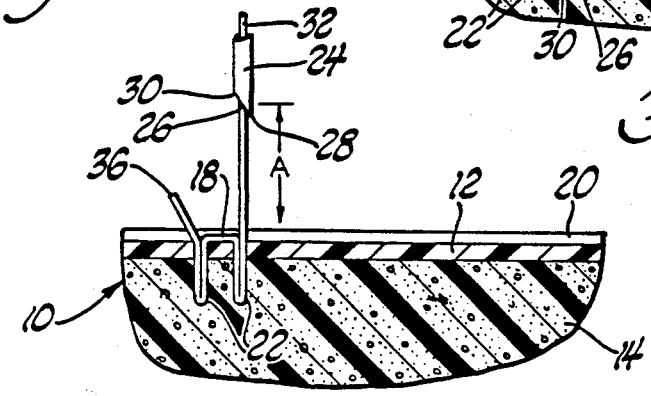

Referring next to FIG. 5, needle 24 is next indexed or advanced to the right parallel to the groove 20, or any other line desired to be stitched, by what may be termed an advancement distance C. C is equal to the length desired for one visible loop 18. So advancing the needle 24 feeds through some additional thread 24, giving a total length D of thread 32, measured from the outer surface 12 to the needle end 26. The length D is longer than the withdrawn distance A, since D is in effect the hypotenuse of a right triangle, A its longer leg, and C the shorter leg. However, given the fact that the advancement distance C is relatively short compared to the withdrawn distance A, the length D is not substantially greater than the distance A. What is required is that the length D be approximately equal to C plus B, that is, D must include sufficient thread 32 to make up a visible loop 18, which will be the first visible loop 18 to be formed, and also to make up one half of the next or adjacent embedded loop 22. Since the advancement distance C is already determined by the desired length of the visible loop 18, how much total thread D is fed through the needle may be best increased or decreased by correspondingly increasing or decreasing the withdrawn distance A. Since the embedment distance B is already determined as well, increasing or decreasing D will consequently decrease or increase the tension of the visible loop 18, as will be next described.

Referring now to FIG. 6, needle 24 is again punched down into the trim part 10 for the distance B. A captured portion of the thread 32 is again dragged down into the foam substrate 14, which pulls that portion of the the thread 32 to the left of the needle 24 tight against the outer surface 12. This creates a visible loop 18. It will be understood that the tension of this visible loop 18 will depend on how much thread 32 is available to make it, that is, it will depend on how much greater D is than B. That tension is best set by experimentation to determine which withdrawn distance A (C being predetermined) gives the proper length D to in turn give the best tension in the visible loop 18. Referring next to FIG. 7, needle 24 is again moved to its withdrawn distance and the next embedded loop 22 is consequently left behind. The retention of the adjacent embedded loops 22 in the substrate 14 described above maintains the visible loop 18 between them in its proper tension against the outer surface 12. For the relatively pliable thread 32 of the first embodiment, the visible loops 18 lie sufficiently flat and in sufficient tension against the outer surface 12 without the necessity of any additional steps. The process described is continued until the desired number of visible loops 18 is created. Finally, the free ends of thread 32, one of which is seen at 36, are clipped off.

Figure 9:
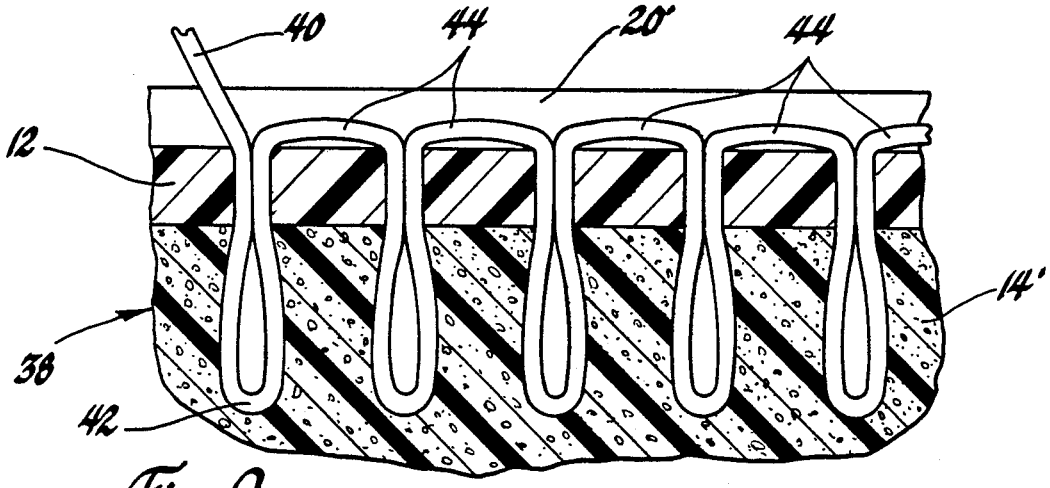
FIGS. 9 and 10 show a trim part including decorative stitching applied by a second embodiment of the method.

Referring next to FIG. 9, a second embodiment of a trim part with decorative stitching according to the invention, is designated generally at 38. The materials of the trim part 38 are the same as the materials of the trim part 10, and are given the same number with a prime. The decorative stitching of the second embodiment has the same pattern and is applied in the same way. However, since the thread used is different, it is given a different number, 40, as are its various loops. Thread 40 is of similar size to thread 32, but is of nylon, a coated cotton material, or some other material that is relatively stiffer, and also heat shrinkable. It may also be coated with a heat curable adhesive, if desired, such as a urethane adhesive. As pictured in FIG. 9, thread 40 has already been applied to the trim part 38 by the same method described above, leaving embedded loops 42 and visible loops 44. The embedded loops 42 are held in the foam substrate 14' in the same manner, although their embedment distance might have to be different depending on the adhering characteristics of the surface of the thread 40. It will be noted, however, that because of the greater stiffness of the thread 40, the bottom of the embedded loop 42 does not make as sharp a bend as the foam substrate 14' closes up on it. The embedded loop 42 actually has an eye shaped bottom portion, which can actually aid in its retention against being pulled out of the foam substrate 14'. Also, because of the greater stiffness of the thread 40, the visible loops 44 are bowed up slightly from the outer surface 12', and do not lie in as great a tension against the outer surface 12' as do the visible loops 18 of the first embodiment 10. Therefore, a subsequent step is added for the second embodiment of the method.

Figure 10:
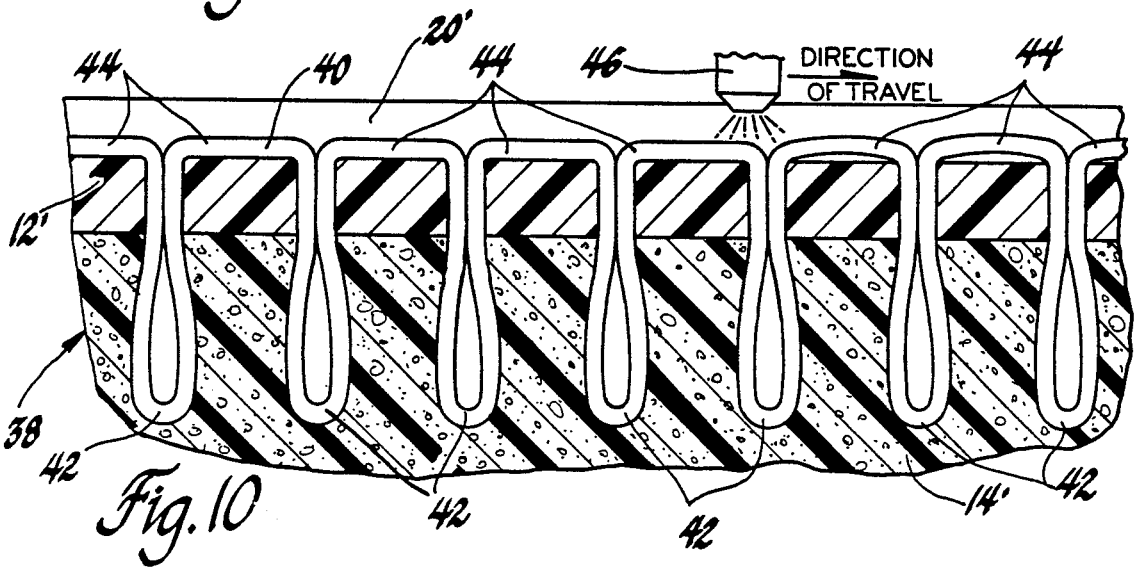

Referring next to FIG. 10, a heat gun 46, one that produces a temperature of approximately 250 degrees F., is run down the line of visible loops 44 as a final step. The application of heat shrinks the bowed up visible loops 44 into a flatter relation to the outer surface 12' and into a tighter tension. If an adhesive is present, that will serve to stick the visible loops 44 to the outer surface 14. Thus, the second embodiment, while basically similar, allows an even tougher, though stiffer, thread 40 to be successfully used.

Variations of the embodiments disclosed are possible within the spirit of the invention. Any thread meeting the requirements described, as well as any trim part having the same basic properties described, would serve. Therefore, the invention is not intended to be limited to just those embodiments disclosed.

The embodiments of the invention is which an exclusive property or privilege is claimed are defined as follows:

1. A method of providing a series of decorative stitches of continuous heat shrinkable thread on the visible outer surface of a trim part having an underlying substrate of relatively thicker resilient material with a hollow needle having a slanted end providing a leading piercing edge and a trailing notch, said series of decorative stitches including visible loops joined by intermediate loops embedded within said substrate so as to maintain said visible loops tensioned against said visible outer surface, comprising the steps of, piercing the outer surface of said trim part with said needle piercing edge while capturing a portion of said thread on said notch, penetrating said trim part with said needle and captured thread portion to an embedment distance less than the thickness of said trim part so as to position said captured thread portion in frictional retaining contact with said underlying substrate, withdrawing said needle from said trim part a withdrawal distance above the outer surface thereof so as to leave an embedded loop in said substrate while continuously feeding a sufficient length of thread through said hollow needle in response to the frictional retention of said thread portion to provide the combined length of a visible loop and one half the next embedded loop, indexing said needle the length of a visible loop, again penetrating said trim part with said needle and captured thread portion to said embedment distance so as to again position said captured thread portion in frictional retaining contact with said underlying substrate with said visible loop between said captured thread portions substantially tensioned against said visible outer surface, repeating the foregoing steps until the desired series of decorative stitches is obtained, and applying heat to said substantially tensioned visible loops so as to shrink them into tighter tension against said visible outer surface.

* * * * *